US009352179B1

(12) United States Patent
Kelly

(10) Patent No.: US 9,352,179 B1
(45) Date of Patent: May 31, 2016

(54) EXERCISE APPARATUS AND METHOD

(71) Applicant: Michael F. Kelly, Newburgh, NY (US)

(72) Inventor: Michael F. Kelly, Newburgh, NY (US)

( * ) Notice: Subject to any disclaimer, the term of this patent is extended or adjusted under 35 U.S.C. 154(b) by 0 days.

(21) Appl. No.: 13/867,751

(22) Filed: Apr. 22, 2013

Related U.S. Application Data

(62) Division of application No. 12/687,752, filed on Jan. 14, 2010, now Pat. No. 8,425,383.

(51) Int. Cl.
*A63B 21/00* (2006.01)

(52) U.S. Cl.
CPC ..... *A63B 21/00047* (2013.01)

(58) Field of Classification Search
CPC ..... A63B 21/00
USPC ..... 434/242; 482/111, 141, 142
See application file for complete search history.

(56) References Cited

U.S. PATENT DOCUMENTS 6,461,284 B1 * 10/2002 Francavilla ..... 482/142
6,478,721 B1 * 11/2002 Hunter ..... 482/140
6,689,026 B2 * 2/2004 Almada ..... 482/140

* cited by examiner

*Primary Examiner* — Jerome W Donnelly
(74) *Attorney, Agent, or Firm* — Calhelha & Doyle, LLC

(57) ABSTRACT

An exercise apparatus accommodates a user and a resilient and resistive pivot such as an exercise ball within its structure. The pivot may have various dimensions based on the size and needs of the user and the exercise program chosen to be performed. The shape and inner dimension of the apparatus is designed to exploit the inherent instability of pivoting exercises such as twists, rolls and lifts. Various configurations of horizontal and vertical apparatus members offer the user a wide range of gripping and leverage points. A variety of exercise positions and motions may be used with this device to increase muscle flexibility and strength.

5 Claims, 7 Drawing Sheets

EXERCISE APPARATUS AND METHOD

CROSS-REFERENCE TO RELATED APPLICATION

This application claims the benefit of co-pending utility application Ser. No. 12/687,752 filed Jan. 14, 2010 and which is incorporated herein by reference.

FIELD OF THE INVENTION

The present invention relates to a device and method that allows a user to safely exploit the inherent instability of physical exercises involving a pivoting position.

BACKGROUND OF THE INVENTION

Pivoting exercises, including sit-ups, abdominal crunches, some push-ups and the like, are very popular but can nonetheless be safely improved by carefully exploiting the inherent instability of the pivoting positions.

For instance, many people use a resilient exercise ball to perform exercises for physical fitness or therapy. The balls have an inherent instability that makes them ideal for core-strengthening exercises. This instability also makes the exercise balls dangerous and challenging to use effectively.

A number of prior designs are intended to increase the stability of the exercise ball and to limit the risk of injury due to the ball's escape from the exercising user's grip. However, by adding external devices to increase the stability of the exercise ball, these designs decrease the benefits that can be obtained by an exercising user who typically uses his own body to keep the ball stable.

The present invention provides an apparatus and an environment that enables users of any age or physical ability to safely exploit the instability of the exercise ball, or other pivot point, to maximize stretching and strengthening.

The use of the presently disclosed device and method of exercising promotes conscious movement and increases body awareness by redirecting and redefining the relationship between the user's physical strength and physical mass.

SUMMARY OF THE INVENTION

The subject device and method of exercise safely and effectively exploits the instability of exercising from a pivoting position, such as by use of an exercise ball from within the confines of a sturdy, stable exercise apparatus and environment.

The subject exercise system includes a leveraging apparatus which can be described as an open air dome-shaped or cage-like apparatus and at least one pivoting point or means for operating with the leveraging apparatus, thereby providing mechanical advantage for the physical exercises.

The lower section of the apparatus is comprised of two circular members or segments thereof oriented horizontally to the floor and held parallel to each other by some number of straight connecting and supporting members. The circular members and segments thereof are generally or often interchangeable in differing versions of the subject leveraging apparatus. The lower section supporting members, such as struts, may be vertical or diagonal, or both, as seen in the accompanying diagrams. The upper section of the apparatus will have one or more overhead structural members providing strength and reinforcement for the device, as well as providing stability and leverage for an exercising user.

In a preferred embodiment of the apparatus, two curved structural members connect at opposite ends to the upper circular member of the lower section of the device and arc overhead, intersecting with each other at a peak formed near the top of the device. Depending upon the method chosen for manufacturing the apparatus, the upper section support members may cross overhead or may be appropriately joined at an intersection, as by welding or mechanical fixture. Other embodiments of the apparatus will utilize additional horizontal support members attached at each end to the vertical arching overhead members. These horizontal members reinforce the device and can also be used for grasping or leverage in the participant's exercise routine.

In some embodiments of the design, each structural member of the apparatus is covered with padding for comfort and safety. Although the apparatus is seen to be generally circular in shape, some embodiments of the device may use hoop segments of appropriate radius, leaving a gap in the lower section of the structure to enable easier access to the inside of the apparatus for less-mobile users.

An optional feature may be a head rest or neck stretching device that can be attached to the apparatus. Such devices may be attached permanently or temporarily to the structural members such as one of the horizontal circular structural members opposite the entrance of the apparatus. Another optional feature may be a seat within the device for more substantial support. For example, for a user desiring to traction thoracic and lumbar spinal muscles, padding here will make it more comfortable to maintain positions where the weight of the lower body imparts significant pressure on the chest. Another additional option is a protrusion braced against an intersection of horizontal and upright members to allow the user to exert pressure on various places on the bottom of the foot, providing leverage as well as facilitating a foot massage.

Other options and alternatives include various sling attachments that are modifiable to accommodate a user's range of motion or limb length, and to facilitate exercise by differently-enabled users.

The method of exercising includes using appropriate hand and foot grips to maximize the stretching of joints or muscles as positioning dictates. For example, a user may use a 55 centimeter size exercise ball, which can make a half turn in any direction when starting at the center of the device, but different size balls offer different exercise opportunities and may be used as desired. Children seem to enjoy using a 55 cm ball as it gives a good lift when holding the upright members of the device and provides a bouncing effect when doing pull-ups, chin-ups, pushups and dips. The substitution of different size exercise balls will enable almost any user to perform successful stretch exercises.

The device may be used by a single user with a single exercise ball or a second exercise ball can be brought into the apparatus. A single user can use both or two users can participate at the same time. In one example, one user can be inside the device and the other user can be on the outside holding onto the upright members of the device. In another example of using the device, a user may stand on the lower bar and hold onto the overhead bars. The intersection of the overhead bars may have a small padded surface, circular in design, to enable the user to hold onto it and dangle their legs below. Adults may decompress their spine using this feature and they are capable of accomplishing this in a number of other positions in and on the device, as well. See the accompanying drawings for various positions for stretching and strengthening exercises.

A variety of exercises can be executed within the space of the device as already mentioned, as well as on the outside of the structure, making this design completely functional and adaptable while retaining simplicity. Those skilled in the art of physical fitness and therapy will recognize that many other exercises and positions may be used with the device.

The exercise system with its significant use of a pivot device such as an exercise ball increases the engagement of the core and collateral muscles, but with the abundance of handholds and footholds provided by the leveraging apparatus, one can readily control the desired amount of movement or challenge and adapt many exercises with only slight changes in position for adults and children.

When using just the bottom half of the device with a 55 cm. exercise ball, a large variety of hand holds are available, as well as foot holds all along the second tier. As the user shifts positions with either or both feet, the user is able to activate core muscle strength. These core muscles are responsible for the stability between the upper and lower body. The user has the opportunity to completely capitalize on the instability of the exercise ball and accept as much challenge as they can handle in terms of gravity and pull. Once activated and challenged, slight movement from side to side, or up and down, strengthens and stabilizes whole muscle groups. The user controls how much exercise to do by tensing the targeted muscles and taking on a gradually increased load. The user determines the degree of muscle engagement by varying the interaction among the device, the ball, gravity and oneself.

The device may be manufactured in different models to satisfy different needs of users. For example, a commercial model intended for use at fitness centers may have welded or thermoformed connections, locked down connectors between arcs and cross members, suitably durable structural members and may be installed using permanent connections to the floor. Floor covering or padding may be used under the apparatus or may be permanently installed to the bottom of the device. Alternatively, a home version may have disconnectable upper and lower sections and the ability to be easily disassembled or folded over for storage.

Other objects, features and advantages of the present invention will be apparent when the detailed descriptions of the preferred embodiments of the invention are considered with reference to the accompanying drawings, which should be construed in an illustrative and not limiting sense as follows:

DETAILED DESCRIPTION OF THE PREFERRED EMBODIMENTS

Figure 1:
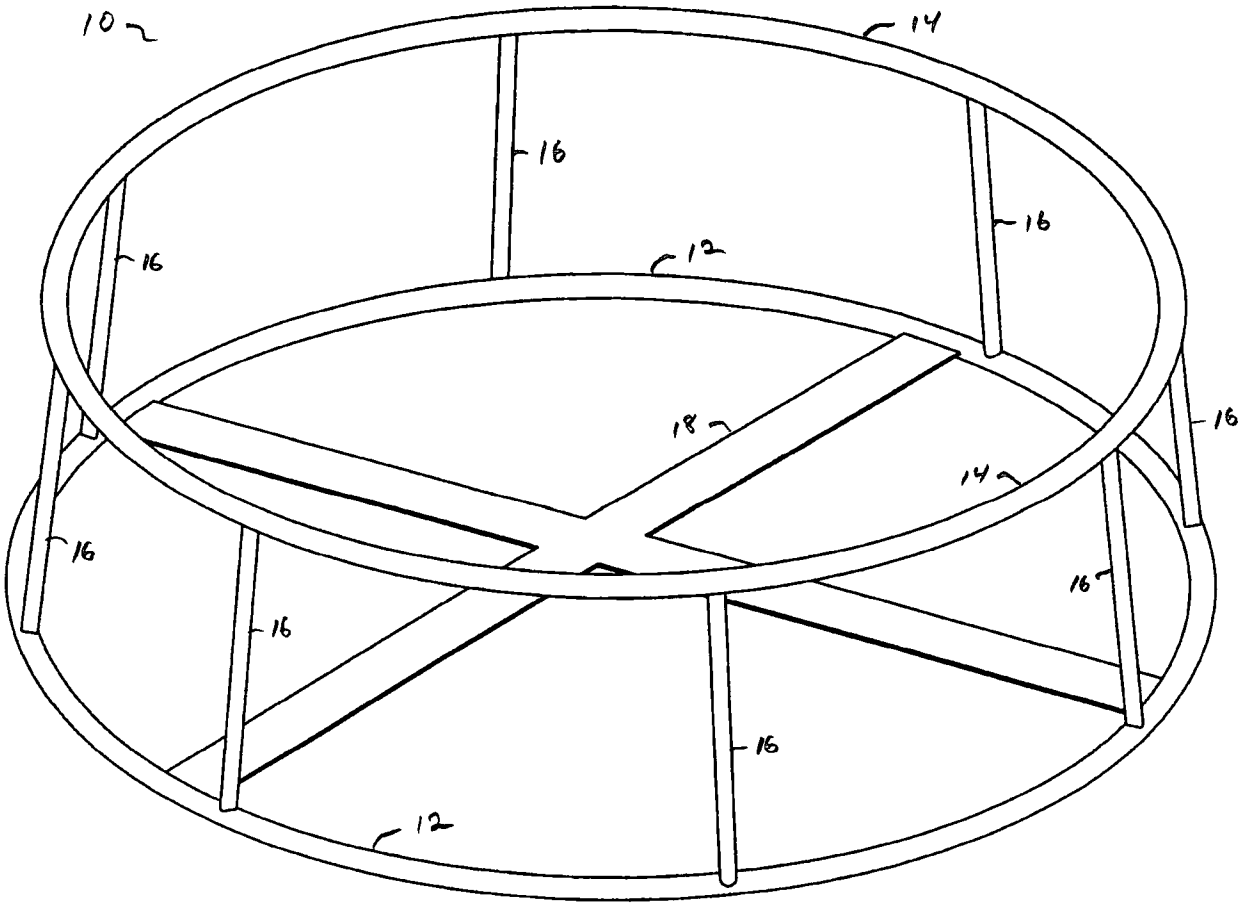
FIG. 1 is a perspective view of the lower section of one embodiment of the subject leveraging apparatus.

An exercise system that allows a user to safely exploit the inherent instability of physical exercises involving a pivoting position, comprises a leveraging apparatus, wherein the leveraging apparatus is comprised of a floor mounted base section having a first circular hoop base member or segment thereof securely positioned upon and parallel to the floor, and a second circular hoop member or segment thereof mounted and securely fastened parallel and above the first hoop base member or segment by a plurality of generally vertical supporting struts, each strut securely mounted at a lower and upper end to the respective first and second hoop members or segments; wherein said struts are of a length providing a height for the second hoop member or segment above the floor permitting a person to enter the leveraging apparatus by stepping over the second hoop member or segment and into the apparatus, the circular hoop members or segments defining an inner area sufficiently large to permit an exercising participant to enter therein; and a resilient and resistive pivoting device positioned within the leveraging apparatus and configured to permit the exercising participant to utilize the leveraging apparatus, thereby providing mechanical advantage for exercises involving pivoting positions.

Each subsequently mounted parallel hoop member or hoop segment has a smaller radius than any prior mounted lower hoop or hoop segment, such members or segments being securely mounted by struts having an inward camber to accommodate the higher, smaller-radius hoop members or segments positioned above, thereby providing additional stability to the apparatus.

The system may further have at least one diagonal stability strut to reinforce the generally vertical struts or parallel hoop members or segments. The lowest circular hoop member or segment may have one or more cross-bracing members for stability of the apparatus.

As noted above, the circular hoop members or sections may be interrupted or incomplete circular segments configured to facilitate entry and egress of an exercising participant in the apparatus and to provide grasping locations.

The apparatus may include one or more additional higher circular hoop members or hoop segments thereof securely positioned and fastened above and parallel to the next lower hoop members or segments.

Preferred embodiments of the leveraging apparatus will have a pair of overhead arching members, crossing and securely attached at a midpoint overhead and securely attached to mounting points on the next lower level circular hoop member or segments thereof. These are useful both for stability of the device and for grasping by the exercising participant.

The system resilient and resistive pivot is configured to interact with actions undertaken by the participant with respect to the leveraging apparatus and provide opposition to forces applied thereon. The pivot may be deployed in a wide number of configurations, as may be desired by a participant. Examples of suitable pivots will include an exercise ball, chair, stool, wheelchair, inflatable pillow, pad, cushion, exercise pad, floor mat, carpet or floor covering, among others. It will be recognized that for many participants, an exercise ball offers an effective combination of resistance and resilience and will be the preferred pivot or fulcrum for many physical exercises. However, the subject system offers similar opportunities for exercise to participants of many abilities. Thus for example, chairs or wheelchairs may be utilized, as effective pivot devices for those who wish to use them. The other pivots listed above may be similarly exploited.

The leveraging apparatus may be constructed from structural members fabricated from steel, aluminum or reinforced composite structural members. These may be fastened by any suitable means including welded intersections or mechanically attached by joints and fasteners. In some applications such as a gym or rehabilitation center, the leveraging apparatus will be permanently mounted upon a floor or platform. In lighter-duty applications, the leveraging apparatus may be made portable with detachable structural members.

A method of exercise involving the above-described apparatus and pivot device allows a user to safely exploit the inherent instability of physical exercises involving a pivoting position and is comprised of the steps of a. placing a resilient and resistive pivoting device within a leveraging apparatus effective for containing the pivoting device and permitting a participant to apply mechanical advantage thereto, whereby the resilient and resistive pivoting device is effective for permitting the participant to utilize the leveraging apparatus for exercises involving a pivoting positions; b. entering the leveraging apparatus by an exercising participant; c. engaging the pivot device with one or more portions of the participant's body; d. separately engaging the leveraging apparatus with one or more different portions of participant's body; and e. applying mechanical advantage, for physical exercising effect, from the leveraging apparatus through a portion of the participant's body to the resilient pivoting device.

Again, the pivot is a resilient and resistive pivoting device positioned within the leveraging apparatus and configured to permit the exercising participant to utilize the leveraging apparatus, thereby providing mechanical advantage for exercises involving pivoting positions. In a further step, the participant may engage the pivot with the participant's abdomen, hips or buttocks to facilitate physical exercises exploiting pivoting positions. Such pivoting exercises include, among others, sit-ups, crunches, twists, rolls, dips, leg-raises, pull-ups or chin-ups.

FIG. 1 depicts one embodiment of leveraging apparatus 10 which may be used in the subject exercise system that allows a user to safely exploit the inherent instability of physical exercises involving a pivoting position. Leveraging apparatus 10 may also be utilized as the lowermost or base section of a larger and more elaborate apparatus as will be depicted in later Figures. Leveraging apparatus 10 has floor mounted base section with a first circular hoop base member 12 securely positioned upon and parallel to a floor, and a second circular hoop member 14 mounted and securely fastened in a plane parallel and above the first hoop base member 12 by a plurality of generally vertical supporting struts 16, each strut 16 securely mounted at a lower and upper end to the respective first and second hoop members 12 an 14 The struts are of a length providing a height for the second hoop member 14 above the floor which permits a person to enter leveraging apparatus 10 by stepping over the second hoop member 14 and into the apparatus, the circular hoop members 12 and 14 defining an inner area sufficiently large to permit an exercising participant to enter therein. Leveraging apparatus 10 will also accommodate a resilient and resistive pivoting device positioned within (shown below) and configured to permit the exercising participant to utilize the leveraging apparatus, thereby providing mechanical advantage for exercises involving pivoting positions. Optional cross-bracing 18 is utilized for stability in this embodiment.

Figure 2:
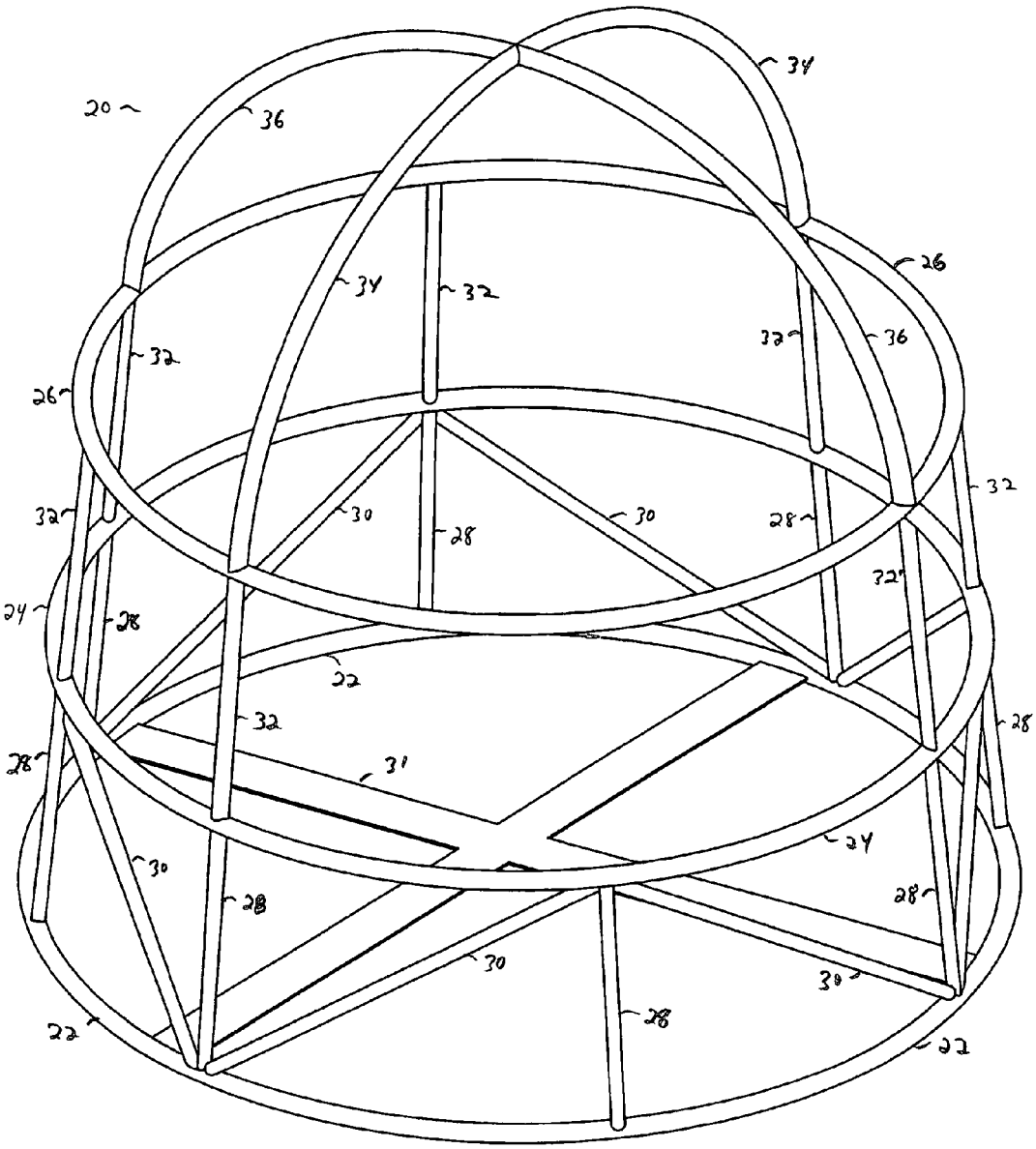
FIG. 2 is a perspective view of another embodiment of the subject leveraging apparatus.

FIG. 2 is another embodiment of a leveraging apparatus 20 having domed or arched elements above its base. In FIG. 2, lower circular hoop member 22 supports several generally vertical struts 28 and other diagonal support struts 30 which together support next higher or second circular hoop member 24 which is in a plane parallel to hoop member 22. Similarly, hoop member 24 supports generally vertical struts 32 which in turn support next higher or third circular hoop member 26 which is also parallel to the lower hoop members. In this embodiment, each circular hoop member has a smaller radius than the lower hoop member preceding it. Thus, each of struts 28 and 32 are cambered inward to securely support the next higher circular hoop member. Also seen in FIG. 2 are arching members 34 and 36 which cross and are secured at a midpoint overhead. In this embodiment, arches 34 and 35 are secured at four points to circular hoop member 26 above four struts 32. Also notable in this embodiment is the absence of an eighth strut 32 in between circular hoop members 24 and 26, thereby facilitating a person's access to the interior of the apparatus. As in the embodiment depicted in FIG. 1, leveraging apparatus 20 will also accommodate a resilient and resistive pivoting device positioned within. Cross-bracing 31 is utilized for stability.

Figure 3:
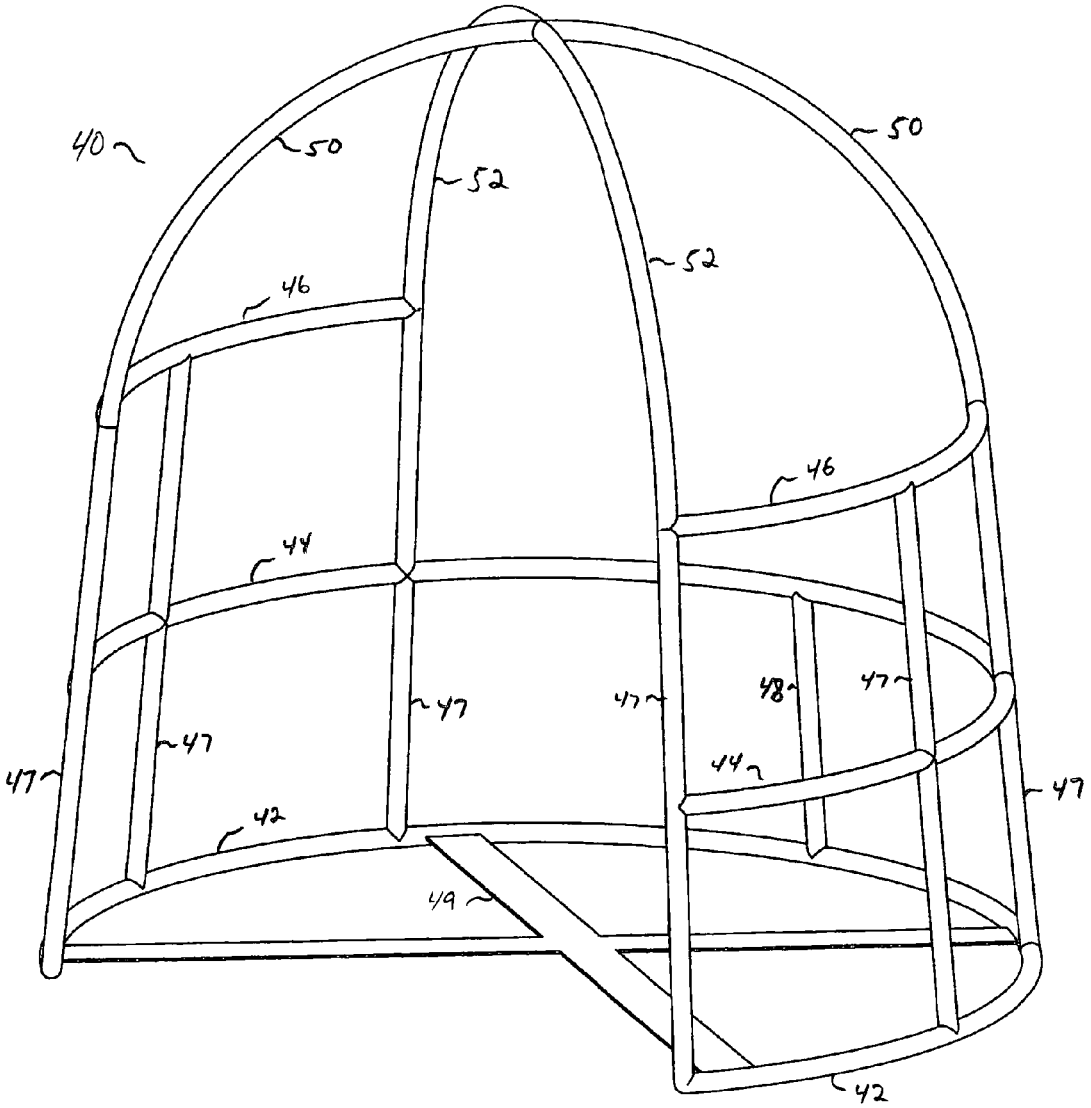
FIG. 3 is a perspective view of a third embodiment of the subject leveraging apparatus.

FIG. 3 depicts a preferred embodiment of leveraging apparatus 40 having an opening configured to allow easy entry and egress by an exercising participant. In this figure, lowermost circular hoop segment 42 supports several struts 47 and further circular hoop segment 44 and higher segment pairs 46. Leveraging apparatus 40 is completed with arching members 50 and 52 secured to circular segments 46 and struts 47. Cross-bracing 49 is affixed to circular hoop segment 42 for additional stability.

A typical embodiment of the subject device could have a lower circular member with a diameter of 5 ft. a second circular member in a plane 15 in. above the first and supported by vertical strut members spaced approximately 20 in. apart around the circular members. In this embodiment, the circular and vertical members are preferably all tubular and joined by welding or mechanical unions. Component assembly materials will generally use aluminum or steel tubing. In other embodiments, the apparatus shape may be grown using wild grasses having adequate structural shape and capabilities for shape formation; and in other embodiments, reinforced plastic components may be used.

Figure 4:
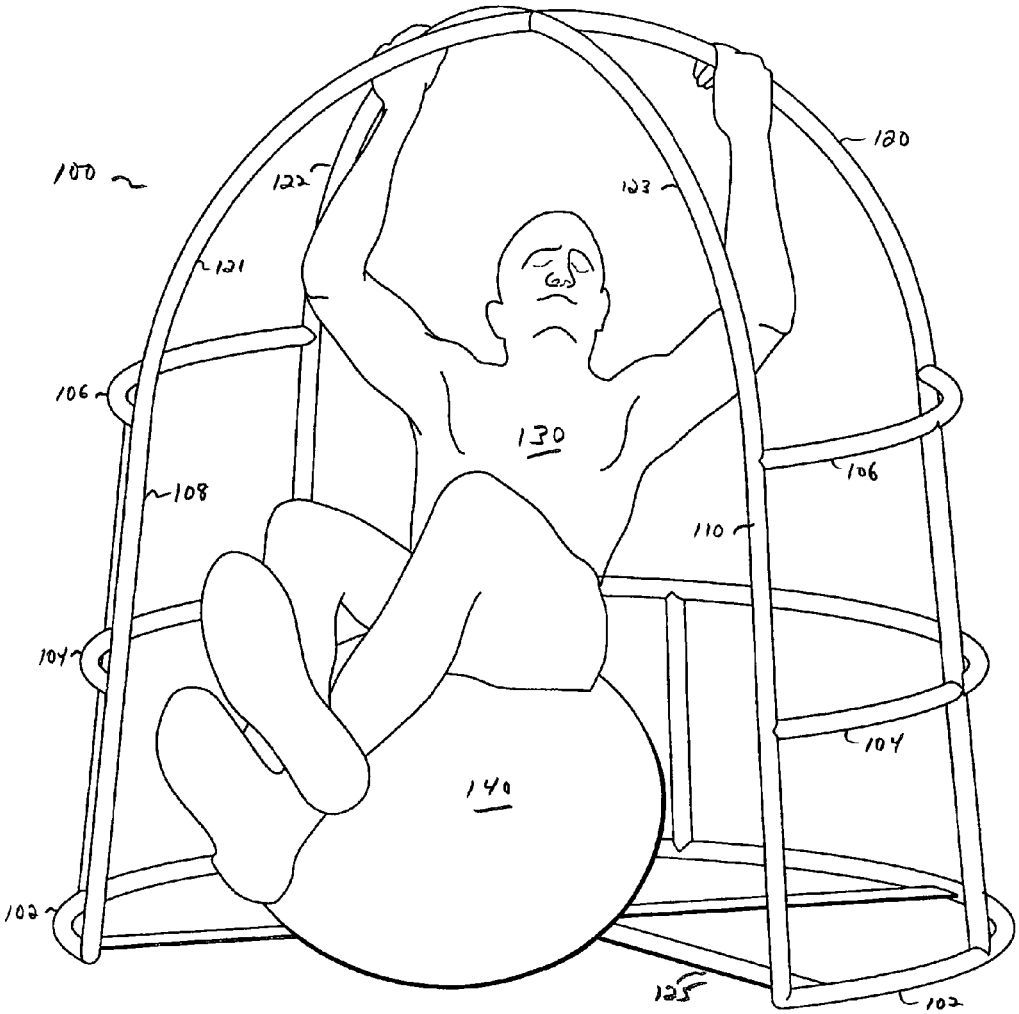
FIGS. 4-7 are perspective views of an exercising participant utilizing the leveraging apparatus of FIG. 3 in combination with a resilient and resistive pivot device.

FIGS. 4-7 depict exemplary exercises that can be performed using the leveraging apparatus shown in FIG. 3. These exercises can also be performed on many alternative embodiments of the described apparatus. In FIG. 4, an exercising participant 130 may sit on an exercise ball 140 with his legs crossed and his hands gripping the upper sections of the upright members 120 and 122.

Figure 5:
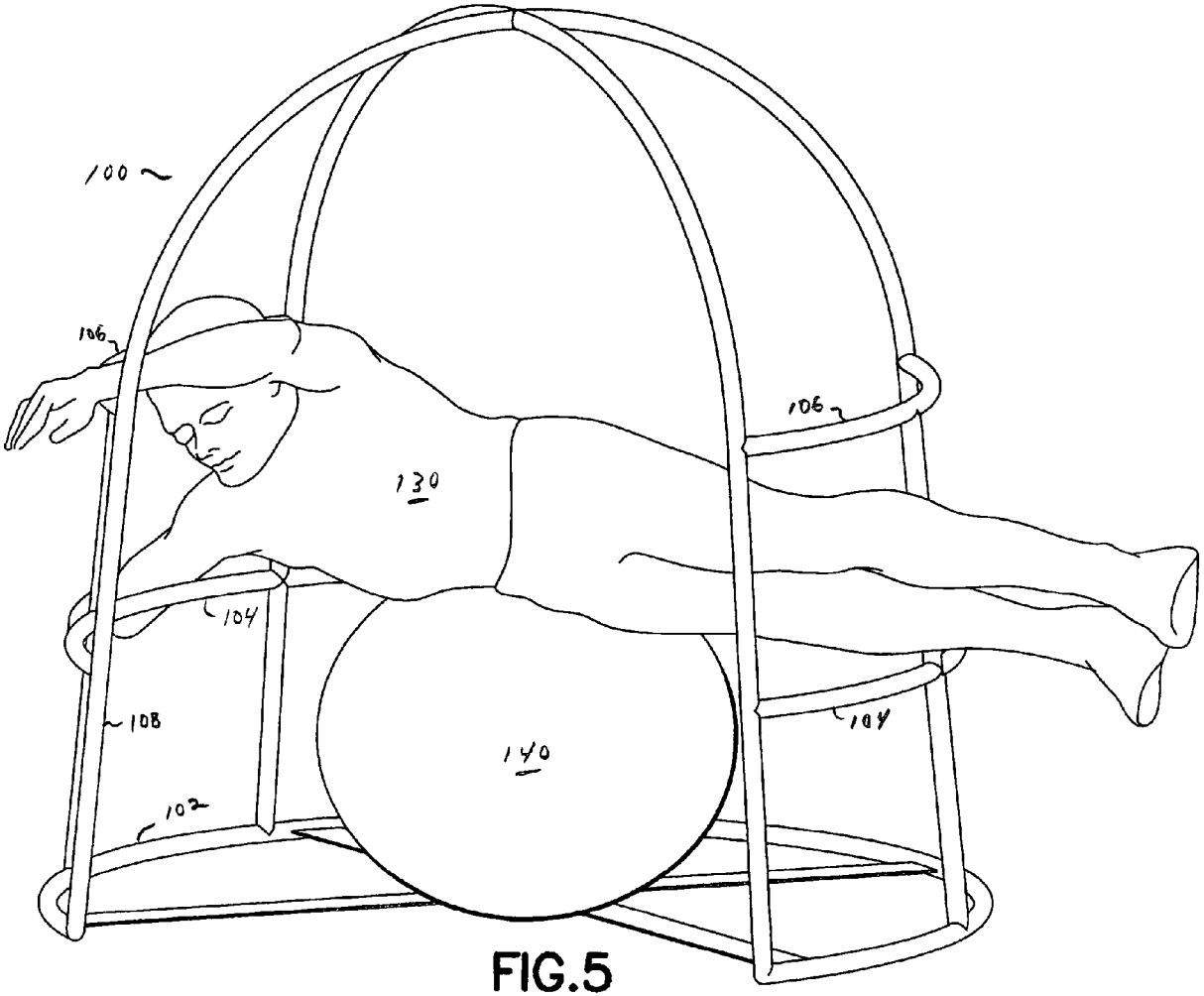

FIG. 5 depicts another exemplary exercise that may be performed using any of the embodiments of the described device. In this example user 130 may lay on his side across the exercise ball 140 with his legs straight out and his hands gripping the circular tubular members 104 or 106.

Figure 6:
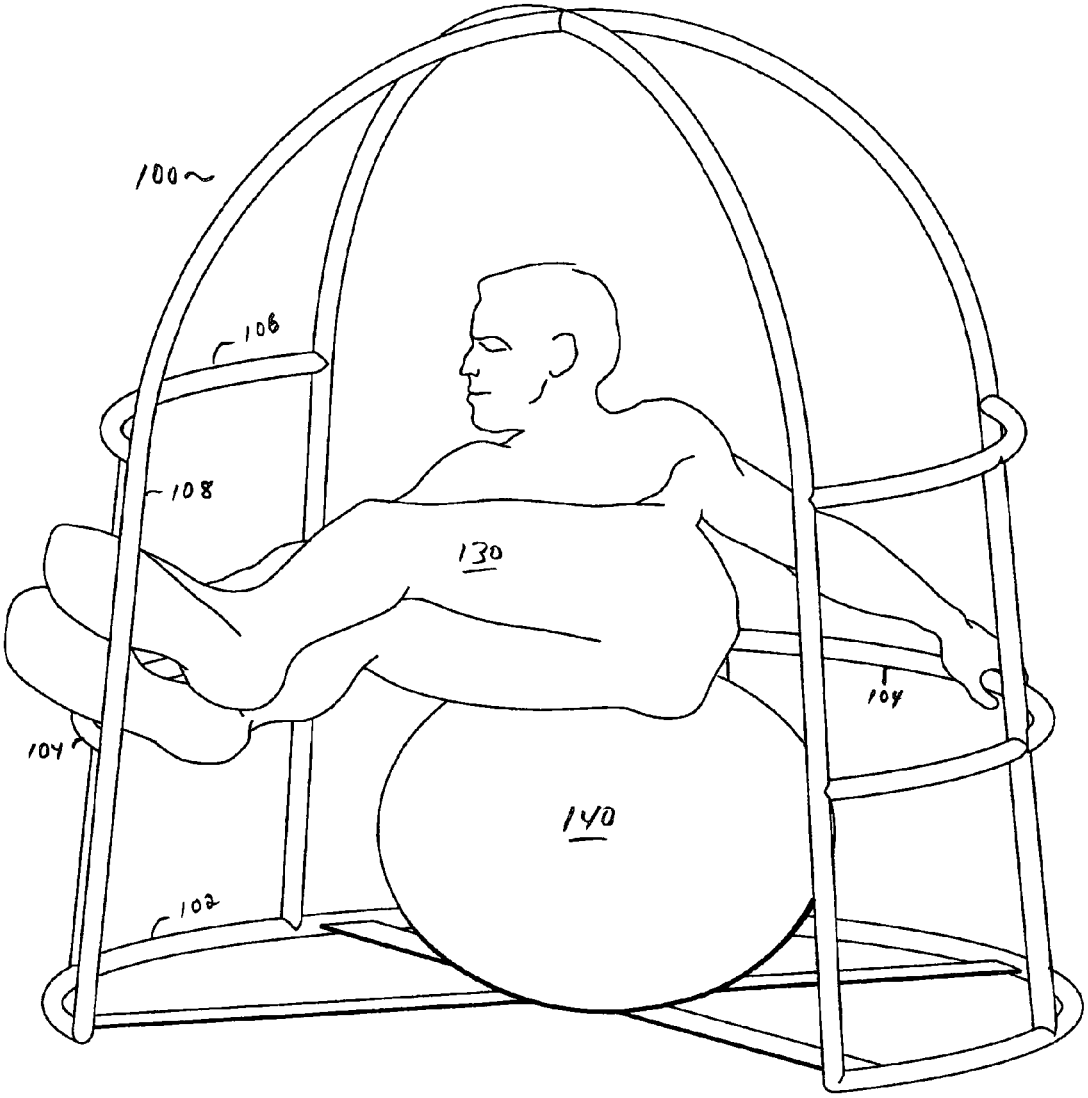

FIG. 6 depicts another exemplary exercise that may be performed using any of the embodiments of the described device. In this example, user 130 may grip the device on circular member 104 for support while using exercise ball 140 to perform oblique abdominal exercises.

Figure 7:
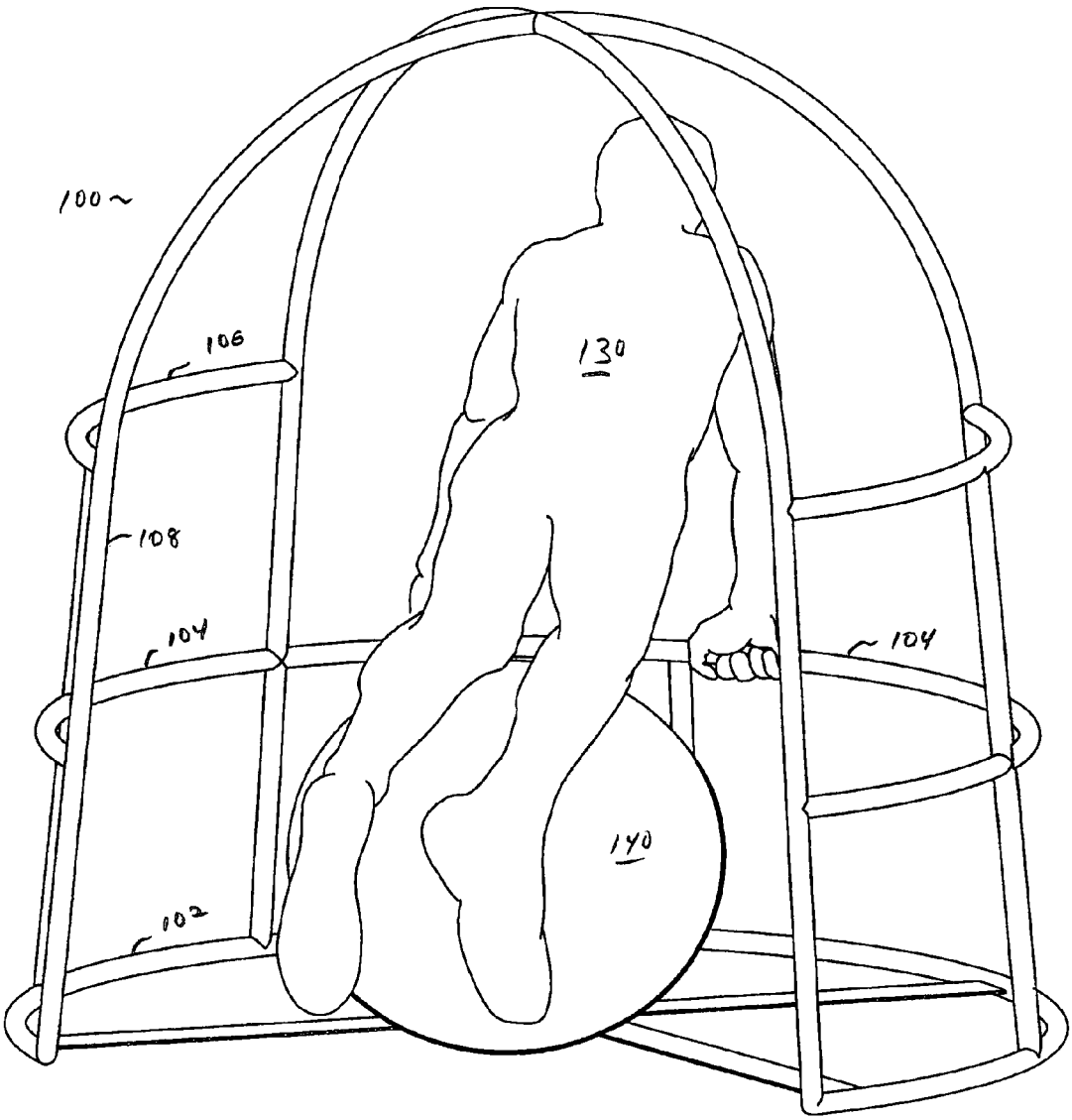

FIG. 7 depicts another exemplary exercise that may be performed using any of the embodiments of the described device. In this example, user 130 may grip circular member 104 while keeping legs straight and on the exercise ball 140, to exercise both the core and upper body.

All of the foregoing exercise activities are exemplary and not limiting. Many additional exercise positions and motions may be utilized.

It will be recognized that the size of the device can be easily varied to accommodate different populations, e.g. children and adults, or commercial gyms, therapeutic offices or home applications. It is contemplated that the device may additionally optionally include inflatable sections to join and interlock within the apparatus for seating comfort or alternative exercise activities.

The invention now being fully described, it will be apparent to one of ordinary skill in the art that many changes and modifications can be made thereto without departing from the spirit or scope of the invention as set forth herein.

The invention claimed is:

1. A method of exercise that allows a user to safely exploit the inherent instability of physical exercises involving a pivoting position, comprising the steps of:

a. placing a resilient and resistive pivoting device within a leveraging apparatus effective for containing the pivoting device and permitting a participant to apply mechanical advantage thereto and controlling a desired amount of side to side movement of the pivoting device within the leveraging apparatus, whereby the resilient and resistive pivoting device is effective for permitting the participant to utilize the leveraging apparatus for exercises involving pivoting positions;

b. entering the leveraging apparatus by an at least one exercising participant;

c. engaging the pivot device with one or more portions of the participant's body;

d. separately engaging the leveraging apparatus with one or more different portions of participant's body; and thereby controlling the side to side movement of the pivoting device by tensing the targeted muscles; and interacting with the leveraging apparatus; and e. applying mechanical advantage, for physical exercising effect, from the leveraging apparatus through a portion of the participant's body to the resilient pivoting device.

2. A method as in claim 1 wherein the leverage apparatus is comprised of a floor mounted base section having a first circular hoop base member securely positioned upon and parallel to the floor, and a second circular hoop member mounted and securely fastened parallel and above the first hoop base member by a plurality of generally vertical supporting struts, each strut securely mounted at a lower and upper end to the respective first and second hoop members;

wherein said struts are of a length providing a height for the second hoop member above the floor permitting a person to enter the leveraging apparatus by stepping over the second hoop member and into the apparatus, the circular hoop members defining an inner area sufficiently large to permit an exercising participant to enter therein.

3. A method as in claim 1 wherein the pivot is a resilient and resistive pivoting device positioned within the leveraging apparatus and configured to permit the exercising participant to utilize the leveraging apparatus and control a desired amount of side to side movement of the pivoting device within the leveraging apparatus, thereby providing mechanical advantage for exercises involving pivoting positions.

4. A method as in claim 1 further comprising the step of engaging the pivot with the exercising participant's abdomen hips or buttocks to facilitate physical exercises exploiting pivoting positions and controlling a desired amount of side to side movement of the pivoting device within the leveraging apparatus.

5. A method as in claim 4 where the pivoting exercises are selected from among sit-ups, crunches, twists, rolls, leg-raises, pull-ups or chin-ups.

* * * * *